US010919738B2

(12) United States Patent
Midorikawa et al.

(10) Patent No.: US 10,919,738 B2
(45) Date of Patent: Feb. 16, 2021

(54) SAFETY DEVICE FOR MOBILE CRANE

(71) Applicant: Maeda Seisakusho Co., Ltd., Nagano (JP)

(72) Inventors: Masakazu Midorikawa, Nagano (JP); Eiji Ichimura, Nagano (JP); Nozomu Toufukuji, Nagano (JP)

(73) Assignee: MAEDA SEISAKUSHO CO., LTD., Nagano (JP)

( * ) Notice: Subject to any disclaimer, the term of this patent is extended or adjusted under 35 U.S.C. 154(b) by 198 days.

(21) Appl. No.: 16/097,408

(22) PCT Filed: Feb. 8, 2018

(86) PCT No.: PCT/JP2018/004472
§ 371 (c)(1),
(2) Date: Oct. 29, 2018

(87) PCT Pub. No.: WO2018/147388
PCT Pub. Date: Aug. 16, 2018

(65) Prior Publication Data

US 2019/0152751 A1 May 23, 2019

(30) Foreign Application Priority Data

Feb. 9, 2017 (JP) ..... 2017-022607

(51) Int. Cl.
*B66C 23/90* (2006.01)
*B66C 23/80* (2006.01)
(Continued)

(52) U.S. Cl.
CPC ..... *B66C 23/90* (2013.01); *B66C 23/80* (2013.01); *B66C 23/905* (2013.01); *B66C 23/94* (2013.01); *B66C 13/22* (2013.01)

(58) Field of Classification Search
CPC ..... B66C 23/90
See application file for complete search history.

(56) References Cited

U.S. PATENT DOCUMENTS 6,138,845 A * 10/2000 Kaspar ..... B62D 33/0633 212/302
6,170,681 B1 * 1/2001 Yoshimatsu ..... B66C 23/905 212/278
(Continued)

FOREIGN PATENT DOCUMENTS

CN 102248933 A 11/2011
DE 102012001185 A1 7/2013
(Continued)

OTHER PUBLICATIONS

International Search Report (with English Translation) and Written Opinion issued in International Patent Application No. PCT/JP2018/004472, (dated May 1, 2018) 11pages.

*Primary Examiner* — Alex C Dunn
(74) *Attorney, Agent, or Firm* — Buchanan Ingersoll & Rooney PC

(57) ABSTRACT

A safety device for a mobile crane has: a permitted work range setting unit that, in accordance with whether or not the overhang angle of each outrigger is a reference overhang angle and the overhang length is the maximum overhang length, sets the permitted work range/non-permitted work range of a crane boom; and a load-specific work range setting unit that, in accordance with whether or not each of the outriggers overhang lengths is a maximum overhang length, sets a maximum RTL work range which is a range, within the permitted work range, in which crane work at a maximum rated total load can be carried out. The crane work capacity on the side of the outrigger having the maximum hangover length with high supporting capacity can be fully utilized within a range over which safety can be ensured.

10 Claims, 13 Drawing Sheets

(51) Int. Cl.
*B66C 23/94* (2006.01)
*B66C 13/22* (2006.01)

(56) References Cited

U.S. PATENT DOCUMENTS

| | | | | |
|---|---|---|---|---|
| 7,677,861 | B1 * | 3/2010 | Fehringer | B66C 23/86 414/680 |
| 8,757,663 | B1 * | 6/2014 | Glazer | B66C 23/80 280/766.1 |
| 9,120,651 | B1 * | 9/2015 | Bailey | B66C 23/90 |
| 10,086,739 | B2 * | 10/2018 | Yustus | B65G 67/04 |
| 2014/0116975 | A1 * | 5/2014 | Benton | B66C 23/88 212/302 |
| 2018/0170322 | A1 * | 6/2018 | Gallione | B60S 9/10 |

FOREIGN PATENT DOCUMENTS

| | | | |
|---|---|---|---|
| JP | S60115618 | U | 8/1985 |
| JP | H03115091 | A | 5/1991 |
| JP | H0812273 | A | 1/1996 |
| JP | 200034093 | A | 2/2000 |
| JP | 2004210540 | A | 7/2004 |
| JP | 2004307188 | A | 11/2004 |
| JP | 2011168342 | A | 9/2011 |
| JP | 2015124051 | A | 7/2015 |

* cited by examiner

FIG. 3
(A)
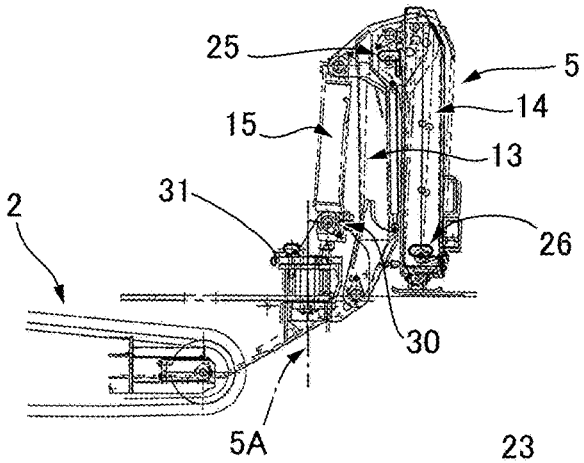
(B)
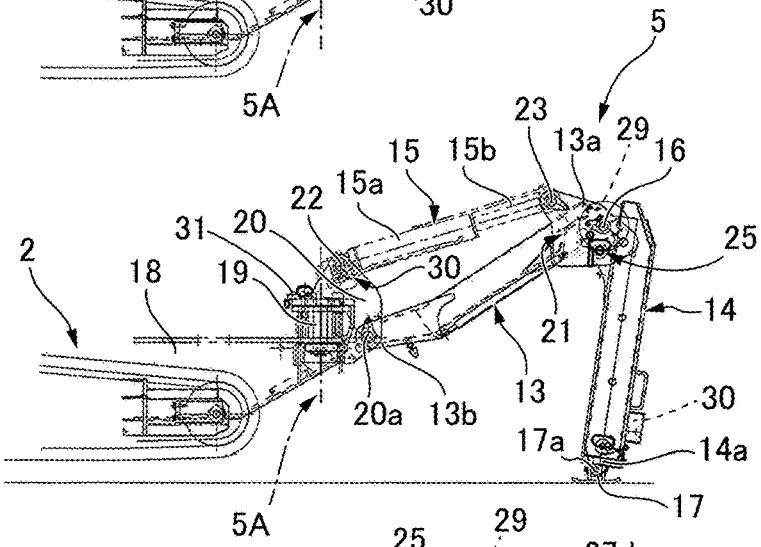
(C)
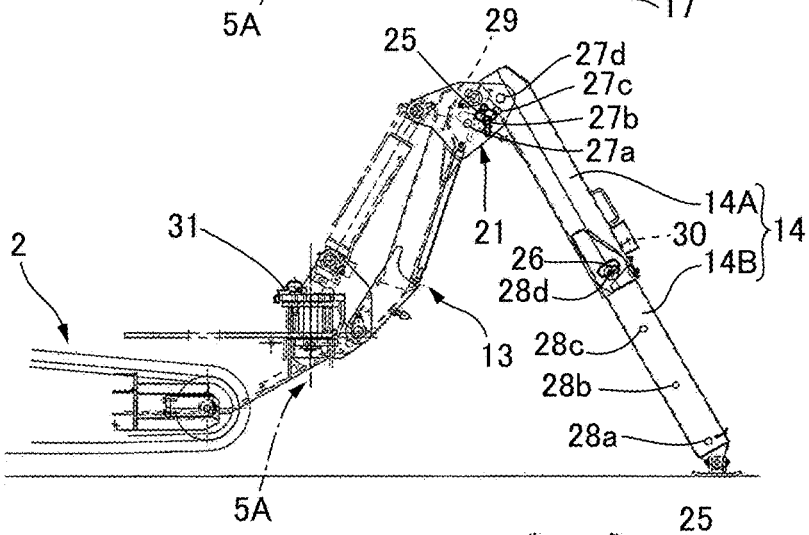
(D)
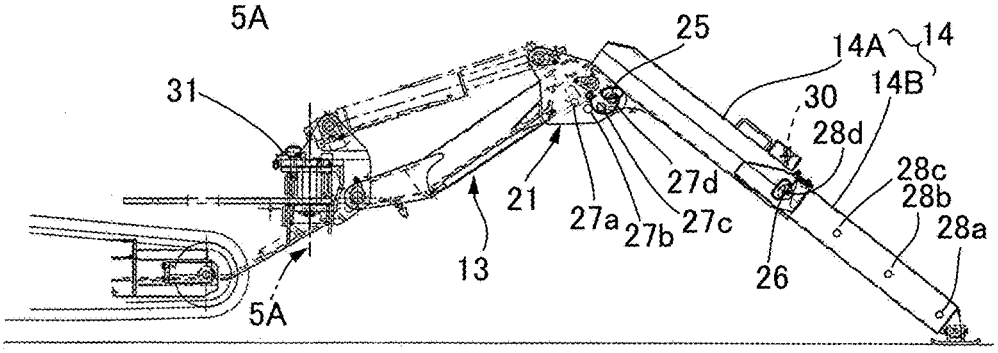

FIG. 10

| PATTERN NO. | PATTERNS OF OUTRIGGER OVERHANG STATE | | | | SPECIFICS OF RESTRICTING OPERATIONS | | |
|---|---|---|---|---|---|---|---|
| | OR1 ① | OR2 ② | OR3 ③ | OR4 ④ | PERMITTED-WORK RANGE | MAXIMUM RTL WORK RANGE | MINIMUM RTL WORK RANGE |
| 1 | MAX | MAX | MAX | MAX | ALL | ALL | NONE |
| 2 | min | min | min | min | ALL | NONE | ALL |
| 3 | MAX | MAX | min | min | ALL | CDE | RANGE OTHER THAN MAXIMUM RTL WORK RANGE IN PERMITTED-WORK RANGE |
| 4 | MAX | MAX | MAX | min | ALL | LABCDE | |
| 5 | MAX | MAX | min | multi | ABCDEFG | CDE | |
| 6 | MAX | MAX | multi | min | ABCDEFG | | |
| 7 | MAX | MAX | multi | multi | ABCDEFG | | |
| 8 | MAX | MAX | MAX | multi | JKLABCDEFG | LABCDE | |
| 9 | min | MAX | MAX | min | ALL | LAB | |
| 10 | min | MAX | MAX | MAX | ALL | IJKLAB | |
| 11 | multi | MAX | MAX | min | GHIJKLABCD | LAB | |
| 12 | min | MAX | MAX | multi | JKLABCDEFG | | |
| 13 | multi | MAX | MAX | multi | JKLABCD | | |
| 14 | multi | MAX | MAX | MAX | GHIJKLABCD | IJKLAB | |
| 15 | min | min | MAX | MAX | ALL | IJK | |
| 16 | MAX | min | MAX | MAX | ALL | FGHIJK | |
| 17 | min | multi | MAX | MAX | GHIJKLA | IJK | |
| 18 | multi | min | MAX | MAX | GHIJKLA | | |
| 19 | multi | multi | MAX | MAX | GHIJKLA | | |
| 20 | MAX | multi | MAX | MAX | DEFGHIJKLA | FGHIJK | |
| 21 | MAX | min | min | MAX | ALL | FGH | |
| 22 | MAX | MAX | min | MAX | ALL | CDEFGH | |
| 23 | MAX | min | multi | MAX | ABCDEFGHIJ | FGH | |
| 24 | MAX | multi | min | MAX | DEFGHIJKLA | | |
| 25 | MAX | multi | multi | MAX | DEFGHIJ | | |
| 26 | MAX | MAX | multi | MAX | ABCDEFGHIJ | CDEFGH | |

FIG. 13
(A)
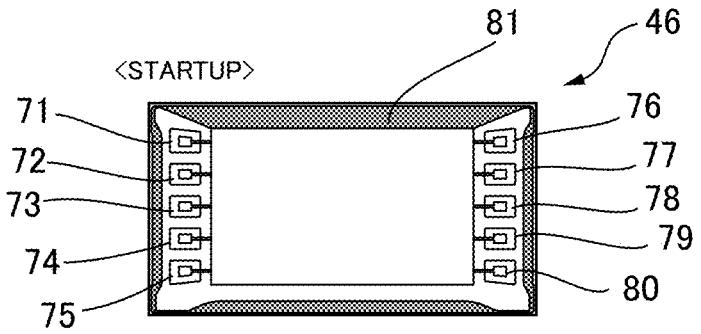
(B)
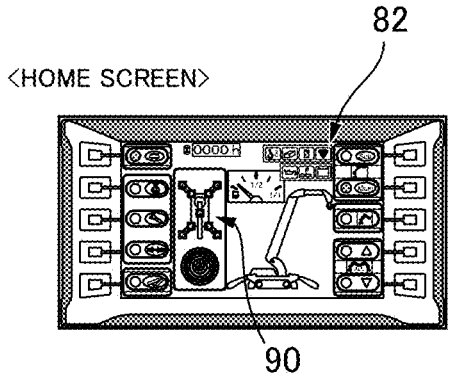
(C)
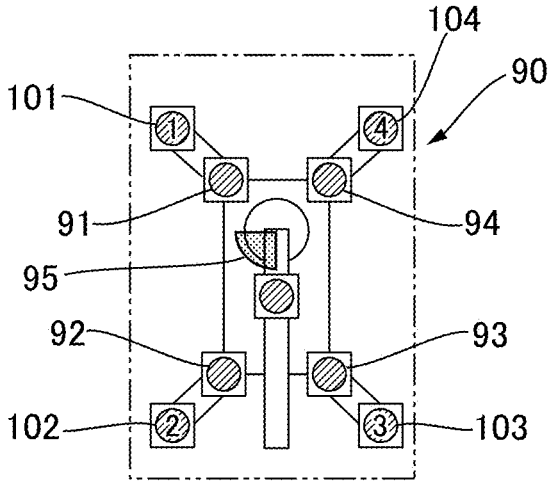

SAFETY DEVICE FOR MOBILE CRANE

TECHNICAL FIELD

The present invention relates to a safety device for a mobile crane. More specifically, the present invention relates to a safety device for a mobile crane, which restricts crane work on the basis of the overhang states of four outriggers of which both overhang length and overhang angle can be varied, the outriggers being attached to a traveling body equipped with a crane boom.

BACKGROUND ART

One known example of a crane is a mobile crane provided with a traveling body comprising a crawler, a knuckle boom or another crane boom installed on the traveling body, and outriggers attached to the four corners of the traveling body. Crane work is carried out in a state in which the outriggers are caused to overhang from the four corners of the traveling body to secure the traveling body in place. An example of a mobile crane is a small-sized mobile crane having a suspension load of less than one ton. Small-sized mobile cranes are not required by law to be furnished with a moment limiter or another load suspension limiting device. However, even a small-sized mobile crane requires countermeasures to prevent overturning, etc., when crane work is being performed.

Commonly, a mobile crane provided with a turnable crane boom is also provided with a safety device. When the crane work state exceeds a safe working range, the safety device automatically forces the crane to stop and prevents overturning, etc., in advance. Patent Documents 1 and 2 each propose a safety device that restricts the turning range of the boom in which crane work can be carried out at a maximum rated load, on the basis of the overhang length of the outriggers.

PRIOR ART DOCUMENT

Patent Documents

Patent Document 1: JP-A 3-115091
Patent Document 2: JP-A 8-12273

SUMMARY OF THE INVENTION

Problems to be Solved by the Invention

In small-sized mobile cranes, etc., there are cases in which it is possible to vary not only the overhang length but also the overhang angle of the four outriggers attached to the traveling body. In many cases in small-sized mobile cranes, crane work is carried out in a small-sized space, etc. In such work spaces, when some outriggers cannot be brought to maximum overhang length, there are cases in which the outriggers cannot be reliably grounded if the overhang angles are not changed. Therefore, the overhang lengths and overhang angles of the outriggers are designed to be individually variable.

Prior-art safety devices for preventing overturning restrict the work range in which crane work can be carried out, in accordance with the overhang lengths of outriggers made to overhang in parallel outward in a width direction from the left and right sides of the traveling body. However, in a prior-art safety device, the outriggers are presumed to have fixed overhang angles. There have been no proposals of a safety device for a mobile crane that can restrict the work range in which crane work can be carried out on the basis of the outrigger overhang states, taking both overhang length and overhang angle into consideration.

The purpose of the present invention is to provide a safety device for a mobile crane that can restrict the work range and rated load of crane work in accordance with the overhang states of the outriggers, of which the overhang length and overhang angle can be varied.

Particularly, the purpose of the present invention is to provide a safety device for a mobile crane with which crane work can be carried out without the risk of overturning, and a wide work range can be ensured, in accordance with the overhang states of the outriggers.

Means of Solving the Problems

The safety device for a mobile crane according to the present invention, which restricts crane work in accordance with the respective overhang states of four outriggers of which both overhang length and overhang angle can be varied, the outriggers being attached to a traveling body equipped with a crane boom, is characterized by having:

a permitted work range setting unit that, in accordance with whether or not each of the outrigger overhang angles is a reference overhang angle, sets a permitted work range in which crane work can be carried out within a crane work area having a maximum work radius centered around a turning center of a crane boom; and a load-specific work range setting unit that, in accordance with whether or not each of the outrigger overhang lengths is a maximum overhang length, sets a maximum RTL work range which is a range, within the permitted work range, in which at least crane work at the maximum rated total load can be carried out.

The crane work area having the maximum work radius can be sectioned into four turning angle ranges of 90 degrees each, in correlation with the four outriggers, centered about the turning center of the crane boom. The permitted work range setting unit sets the turning angle ranges assigned to the outriggers, at which the overhang angles are the reference overhang angle, to the permitted work range.

Crane stability is poor on a side having an outrigger overhanging in a different direction from the reference overhang angle. When the crane boom is turned toward such an outrigger side and crane work is carried out, there is a high danger of the crane overturning. By setting only the side with an outrigger having an overhang angle at the reference overhang angle to the permitted work range, the danger of overturning, etc., caused by the outrigger overhang angle can be avoided. Within the permitted work range, a range in which crane work at the maximum rated total load can be carried out (the maximum RTL work range) is set according to the overhang lengths of the outriggers. Crane work performance on the side with an outrigger at maximum overhang length, where support performance is high, can be broadened within the allowing range. Crane work can also be safely carried out by lowering crane work performance in the side with an outrigger having low support performance and short overhang length. Consequently, according to the present invention, crane work performance can be utilized at the maximum limit within a range in which crane work can be carried out safely.

When there is a failure to fulfill a condition that the overhang angles of the four outriggers all be the reference overhang angle, or a condition that the overhang angles of at least two outriggers be the reference overhang angle, the overhang lengths be the maximum overhang length, and these two outriggers be located adjacent at the front and rear or the left and right of the traveling body, the permitted work range setting unit sets the entire crane work area to a non-permitted work range in which crane work cannot be carried out, without setting a permitted work range.

When two outriggers positioned along a diagonal direction of the traveling body have overhang angles different from the reference overhang angle, crane stability is extremely poor. In this case, crane work is prohibited, and safety can therefore be ensured.

Next, in the mobile crane, because of the layout relationship among components the turning center of the crane boom is commonly positioned farther to the rear than the longitudinal center of the traveling body. The outrigger on the right rear side of the traveling body is referred to as the first outrigger, the outrigger on the right front side of the traveling body is referred to as the second outrigger, the outrigger on the left rear side of the traveling body is referred to as the fourth outrigger, and the outrigger on the left front side of the traveling body is referred to as the third outrigger. In this case, the reference overhang angle of the first and fourth outriggers is a first overhang angle less than 90 degrees, respectively to the left and right relative to the traveling body longitudinal direction, and the reference overhang angle of the second and third outriggers is a second overhang angle less than 90 degrees, respectively to the left and right relative to the traveling body longitudinal direction, the second overhang angle being greater than the first overhang angle. For example, the first overhang angle is 45° and the second overhang angle is 60°. The present invention can be applied when the turning center is positioned in the longitudinal center of the traveling body, and also when the reference overhang angles of the front and rear outriggers are the same.

In this case, the maximum RTL work range can be set as follows, in accordance with the overhang state of the outriggers. First, the crane work area is sectioned into eight turning ranges as follows.

A front turning range LAB over an angle less than 90 degrees to the left and right, centered about a forward line A extending forward along the traveling body from the turning center;

a right turning range CDE over an angle less than 90 degrees forward and backward, centered about a rightward line D extending rightward along the traveling body from the turning center;

a rear turning range FGH over an angle less than 90 degrees to the left and right, centered about a rearward line G extending rearward along the traveling body from the turning center;

a left turning range IJK over an angle less than 90 degrees forward and backward, centered about a leftward line J extending leftward along the traveling body from the turning center;

a forward-right turning range BC between the front turning range and the right turning range;

a rearward-right turning range EF between the rear turning range and the right turning range;

a rearward-left turning range HI between the rear turning range and the left turning range; and a forward-left turning range KL between the left turning range and the front turning range.

The load-specific work range setting unit:

sets at least the right turning range CDE to the maximum RTL work range when the second and first outriggers at the front and rear on the right side are in the maximum overhang state MAX (when the overhang angle is the reference overhang angle and the overhang length is the maximum overhang length);

sets at least the rear turning range FGH to the maximum RTL work range when the fourth and first outriggers at the left and right on the rear side are in the maximum overhang state MAX (the overhang angle is the reference overhang angle and the overhang length is the maximum overhang length);

sets at least the left turning range IJK to the maximum RTL work range when the fourth and third outriggers at the front and rear on the left side are in the maximum overhang state MAX (the overhang angle is the reference overhang angle and the overhang length is the maximum overhang length); and sets at least the front turning range LAB to the maximum RTL work range when the third and second outriggers at the left and right on the front side are in the maximum overhang state MAX (the overhang angle is the reference overhang angle and the overhang length is the maximum overhang length).

There are cases in which, in the permitted work range, the circular area of the minimum RTL work range in which crane work can be carried out at the minimum rated total load can be altogether set to the maximum RTL work range.

In addition, the range other than the maximum RTL work range in the permitted work range can be set to the minimum RTL work range in which crane work can be carried out at the minimum rated total load.

BRIEF DESCRIPTION OF THE DRAWINGS

FIGS. 3(A) to (D) are explanatory drawings showing the overhang states of the outriggers of the mobile crane;

FIG. 10 is a table showing the relationship between patterns in outrigger overhang states and the specifics of restricting operations in crane work;

FIGS. 13(A), (B), and (C) are explanatory drawings showing examples of display screens of the mobile crane.

MODE FOR CARRYING OUT THE INVENTION

An embodiment of a mobile crane to which the present invention is applied and in which a safety device is incorporated is described below with reference to the drawings. The embodiment described below presents one example of the present invention, and the present invention is not limited to the configuration of the embodiment.

(Overall Configuration)

Figure 1:
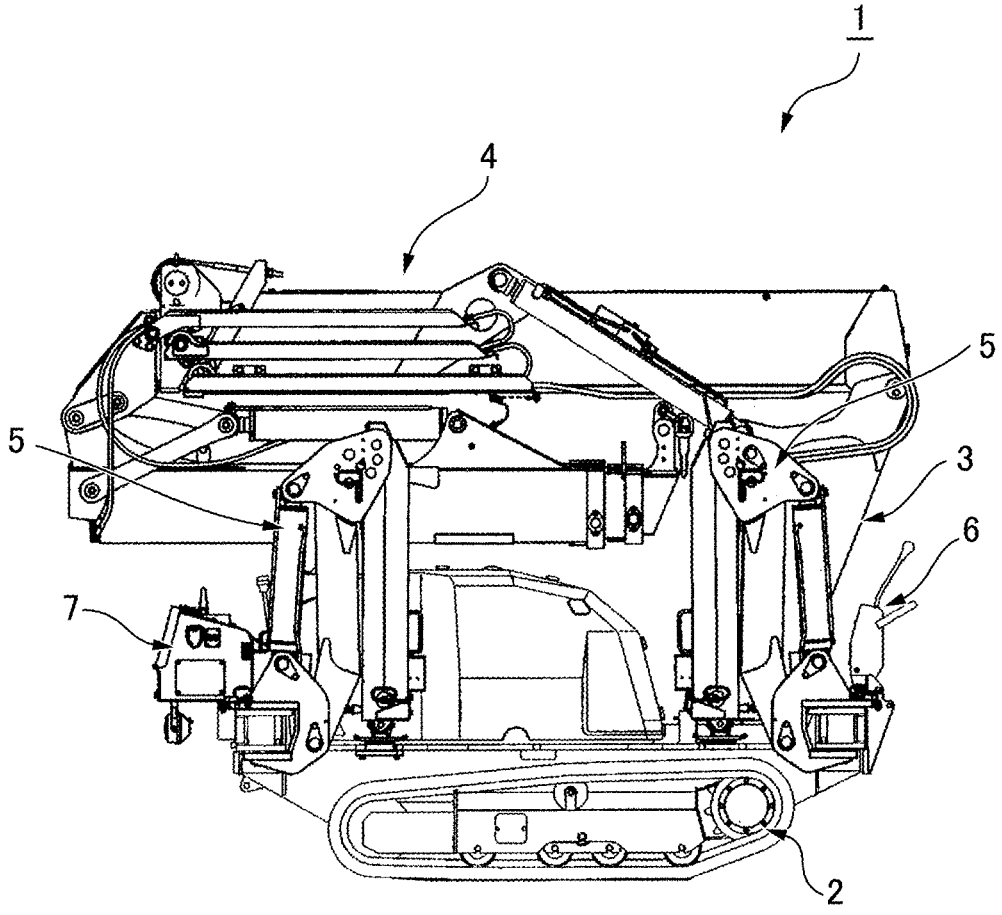
FIG. 1 is a front view of a small-sized mobile crane to which the present invention is applied.
Figure 2:
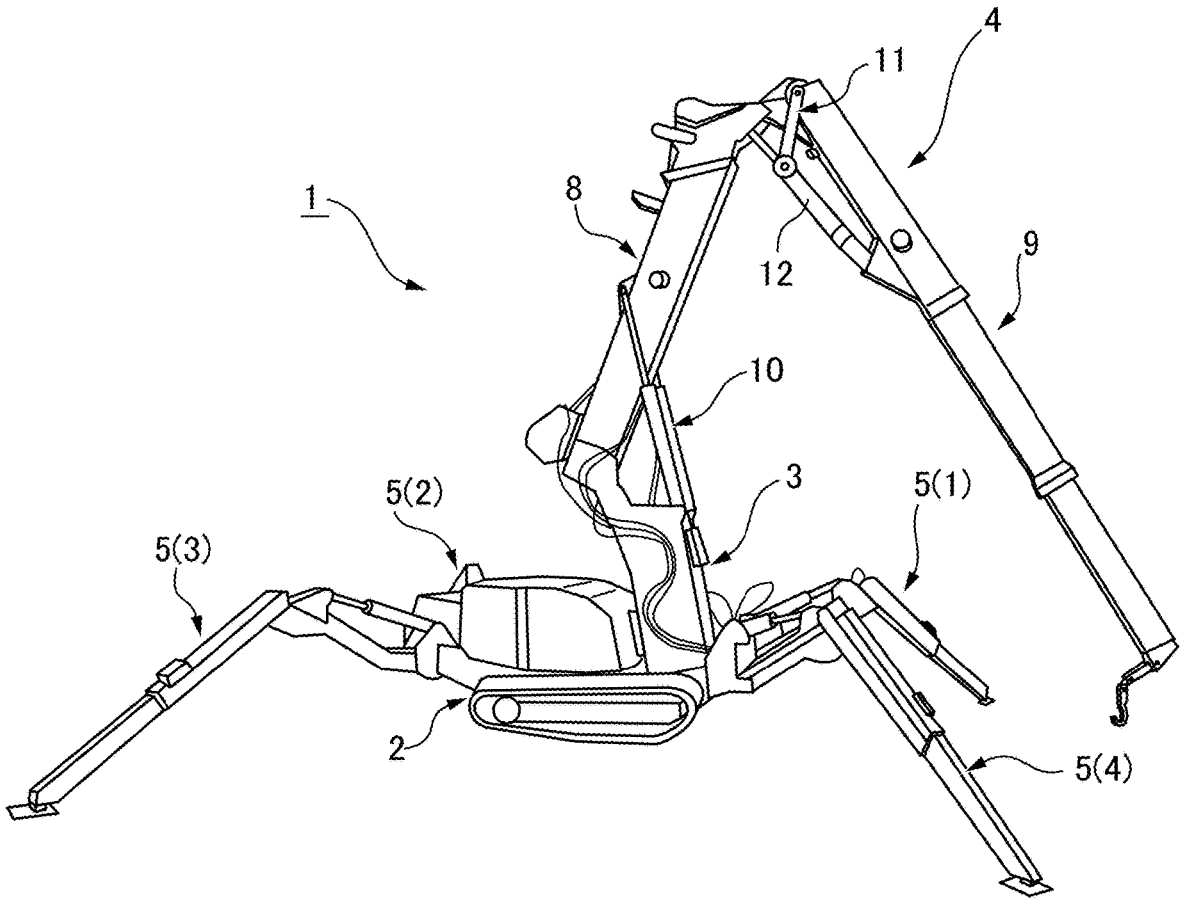
FIG. 2 is an explanatory drawing of an example of a working state of the mobile crane.

FIG. 1 is a front view showing a small-sized mobile crane according to the present embodiment, and FIG. 2 is an explanatory drawing showing an example of a working state of the crane. The mobile crane 1 is provided with a traveling body 2 comprising a crawler. A boom turning base 3 is mounted on the traveling body 2, and a knuckle boom-type crane boom 4 is attached to the boom turning base 3. The crane boom 4 may of course be some type other than a knuckle boom. Four outriggers 5(1) to 5(4) (sometimes collectively referred to as "outriggers 5" below) are also attached to the four corners of the traveling body 2. An operation lever 6 of the traveling body 2 is disposed at one end of the traveling body 2, and a control panel 7 is mounted at the other end of the traveling body 2.

The crane boom 4 includes a first boom 8 and a second boom 9, and the rear end part of the first boom 8 is attached to the boom turning base 3 so as to be capable of rising and falling while centered about a horizontal pin (not shown). When the boom turning base 3 is caused to turn about a turning center, the first boom 8 turns in a left-right direction. A pair of rising/falling cylinders 10 span between the boom turning base 3 and the first boom 8, and the first boom 8 is raised and lowered by the extending and contracting of the rising/falling cylinders 10. The distal end part of the first boom 8 and the rear end part of the second boom 9 are linked by a knuckle boom joint mechanism 11. When a cylinder 12 of the knuckle boom joint mechanism 11 is extended or contracted, the second boom 9 can be raised and lowered relative to the first boom 8. The second boom 9 is a multi-stage boom and is capable of extending and contracting in an axial direction thereof.

From the stowed state shown in FIG. 1, the outriggers 5 are caused to turn and overhang so as to face outward, and the traveling body 2 is caused to rise off the ground surface. The mobile crane 1 is fixed in a stable state as shown in FIG. 2. In this state, the crane boom 4 is raised and lowered, and extended and contracted, and crane work is performed.

FIGS. 3(A) to (D) are explanatory drawings showing movements of the outriggers 5. FIG. 3(A) shows a lowered state in which the stowed outriggers 5 (see FIG. 1) have been turned and rotated outward, and FIGS. 3(B), 3(C), and 3(D) show a state in which the outriggers 5 are caused to overhang.

The outriggers 5 each include a first arm 13, a second arm 14, and an outrigger cylinder 15. The second arm 14 is linked to a distal end part 13*a* of the first arm 13 so as to be capable of rotating about a horizontal linking pin 16. The second arm 14 is a two-stage arm, and an inner box 14B can be extended from the distal end of an outer box 14A as shown in FIGS. 3(B) and (C). A ground plate 17 is attached via a swinging pin 17*a* to a distal end part 14*a* of the inner box 14B.

Turning shafts 19, which are capable of rotating about vertical axes, are attached to the traveling body 2 at the four corners of the upper surface of a traveling body frame 18 of the traveling body 2. Brackets 20 overhanging sideways and upwards are attached to the turning shafts 19. In the regions of the brackets 20 that overhang sideways, rear end parts 13*b* of the first arms 13 are linked via horizontally arranged raising/lowering pins 20*a*, so as to be capable of swinging vertically.

Each of the outrigger cylinders 15 spans between the upward overhanging region of the bracket 20 of the turning shaft 19 and an outrigger base 21 attached to the distal end part 13*a* of the first arm 13. A rear end part of a cylinder main body 15*a* of the outrigger cylinder 15 is linked to the bracket 20 via a horizontal linking pin 22, and a distal end part of an extending/contracting rod 15*b* of the outrigger cylinder 15 is linked to the outrigger base 21 via a horizontal linking pin 23.

(Overhanging State of Outriggers)

The overhang lengths and overhang angles of the outriggers 5 can be varied. The overhang lengths can be varied by varying the insertion positions of position pins 25 relative to the outrigger bases 21, and by varying the insertion positions of position pins 26 relative to the inner boxes 14B. Each of the position pins 25 at the sides of the outrigger bases 21 can be inserted into a plurality of pin holes 27*a* to 27*d* aligned at angular intervals in the same circle centered about the horizontal linking pin 16. By passing a position pin 25 through one of the pin holes 27*a* to 27*d* and a pin hole formed in the side of the outer box 14A, the angle of the first and second arms 13, 14 can be switched to four stages, from the stowed state of FIG. 3(A) to the most opened state shown in FIG. 3(D). There are also cases in which this angle can be switched to a number of stages other than four, e.g., two stages or three stages.

Each of the position pins 26 at the sides of the outer boxes 14A can be inserted into a plurality of pin holes 28*a* to 28*d* provided at prescribed intervals along the axial directions of the inner boxes 14B. By changing the pin hole 28*a* to 28*d* in which the position pin 26 is inserted, the length of the second arm 14 can be switched from the shortest state shown in FIGS. 3(A) and (B) to the longest state shown in FIGS. 3(C) and (D).

At the maximum overhang length of an outrigger 5, the position pin 25 is inserted into the pin hole 27*d* and the position pin 26 is inserted into the pin hole 28*d*, as shown in FIG. 3(D). The other states shown in FIGS. 3(B), (C), etc., are states other than maximum overhang length.

Detecting the position of the position pin 25 (the open angle between the first and second arms 13, 14) involves the use of, for example, a proximity sensor 29 attached to the outrigger base 21. Detecting the position of the position pin 26 (the overhang length of the second arm 14) involves the use of, for example, a limit switch 30 attached to the outer box 14A. It is apparent that the overhang lengths of the outriggers 5 can be detected using detection mechanisms other than the proximity sensors 29 and the limit switches 30. For example, the overhang lengths can be detected using length measuring devices or potentiometers.

The overhang angles of the outriggers 5 can be varied by causing the outriggers to turn about turning centers 5A defined by the turning shafts 19. In the present example, the overhang angles of the outriggers 5 are detected by limit switches 31 attached to positions set in proximity to the outer peripheries of the turning shafts 19. Potentiometers or other detection mechanisms may of course be used as the mechanisms for detecting the overhang angles.

Figure 4:
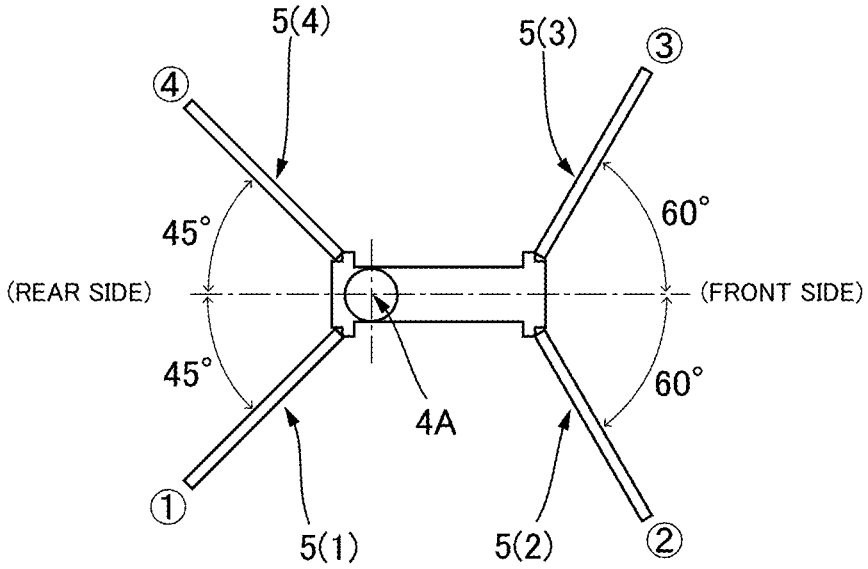
FIG. 4 is an explanatory drawing showing a state of reference overhang angles of the four outriggers.

FIG. 4 is an explanatory drawing showing a state of reference overhang angles of the outriggers 5. In the mobile crane 1 of the present example, a turning center 4A of the crane boom 4 is positioned to the rear of the longitudinal center of the traveling body 2. In the following description, first and second outriggers 5(1), 5(2) are positioned on the right side of the traveling body 2, third and fourth outriggers 5(3), 5(4) are positioned on the left side of the traveling body 2, the first and fourth outriggers 5(1) and 5(4) are positioned on the rear side of the traveling body 2, and the second and third outriggers 5(2), 5(3) are positioned on the front side of the traveling body 2.

The reference overhang angles of the outriggers 5(1) and 5(4) are each set in the present example to a 45 degree angle (a first overhang angle) respectively to the left and right relative to the traveling body longitudinal direction. The reference overhang angles of the second and third outriggers 5(2), 5(3) are each set to a 60 degree angle (a second overhang angle) respectively to the left and right relative to the traveling body longitudinal direction. The values of these reference overhang angles are the optimal values set on the basis of the degree of crane stability, etc., when the outriggers overhang at maximum length.

(Control System)

Figure 5:
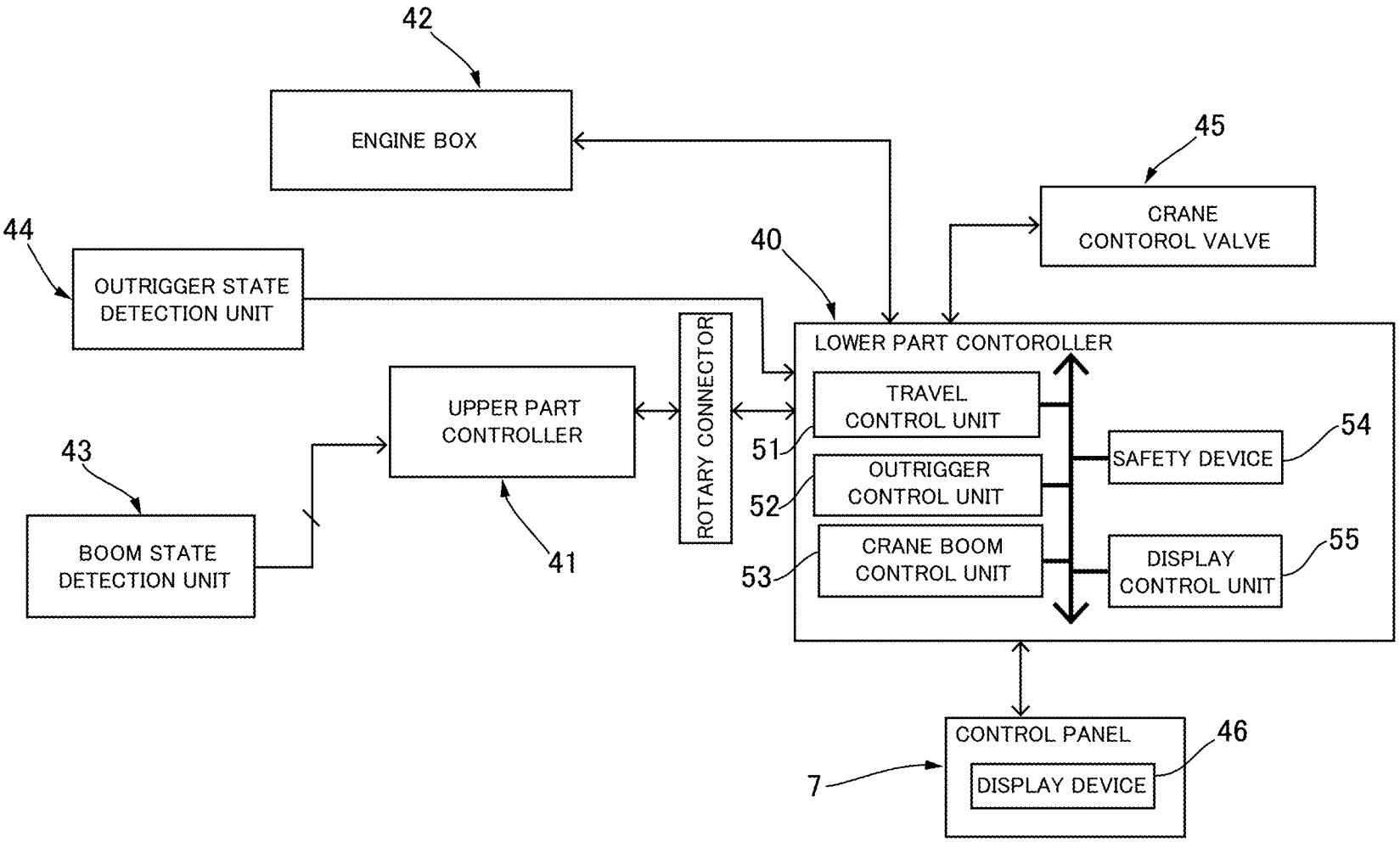
FIG. 5 is a schematic block diagram showing the control system of the mobile crane.

FIG. 5 is a schematic block diagram showing the control system of the mobile crane 1. The control system generally includes a lower part controller 40 installed in the traveling body 2, and an upper part controller 41, an engine box 42, and an operation/display control panel 7, which are installed in the boom turning base 3. On the basis of operation inputs, etc., the driving of the traveling body 2 is controlled via the lower part controller 40 and the engine box 42.

Detection signals from a boom state detection unit 43, which is configured from various sensors that detect the state of the crane boom 4, are inputted to the lower part controller 40 via the upper part controller 41. Additionally, the lower part controller 40 receives input such as detection signals, from an outrigger state detection unit 44, which is configured from various sensors that detect the states of the outriggers 5. On the basis of these signals, the lower part controller 40 controls, inter alia, a crane control valve 45 of a hydraulic circuit for driving the components. A variety of information, including the active states of the crane boom 4, the outriggers 5, etc., is displayed on a display screen of a display device 46 of the control panel 7.

The lower part controller 40 includes a travel control unit 51 for the traveling body 2, an outrigger control unit 52 that controls the operations of the outriggers 5, and a crane boom control unit 53 that controls the operations of the crane boom 4. Also included is a safety device 54 that, on the basis of the overhanging states, suspending loads, etc., of the crane boom 4 and the outriggers 5, performs operation restriction for, inter alia, preventing the mobile crane 1 from overturning. Under restriction by the safety device 54, the operations of the components are controlled by the travel control unit 51, the outrigger control unit 52, and the crane boom control unit 53. Furthermore, the lower part controller 40 includes a display control unit 55 that controls the display of the display device 46. The controlling operations of the travel control unit 51, the outrigger control unit 52, and the crane boom control unit 53 are the same as in the case of a common crane and are therefore not described.

Figure 6:
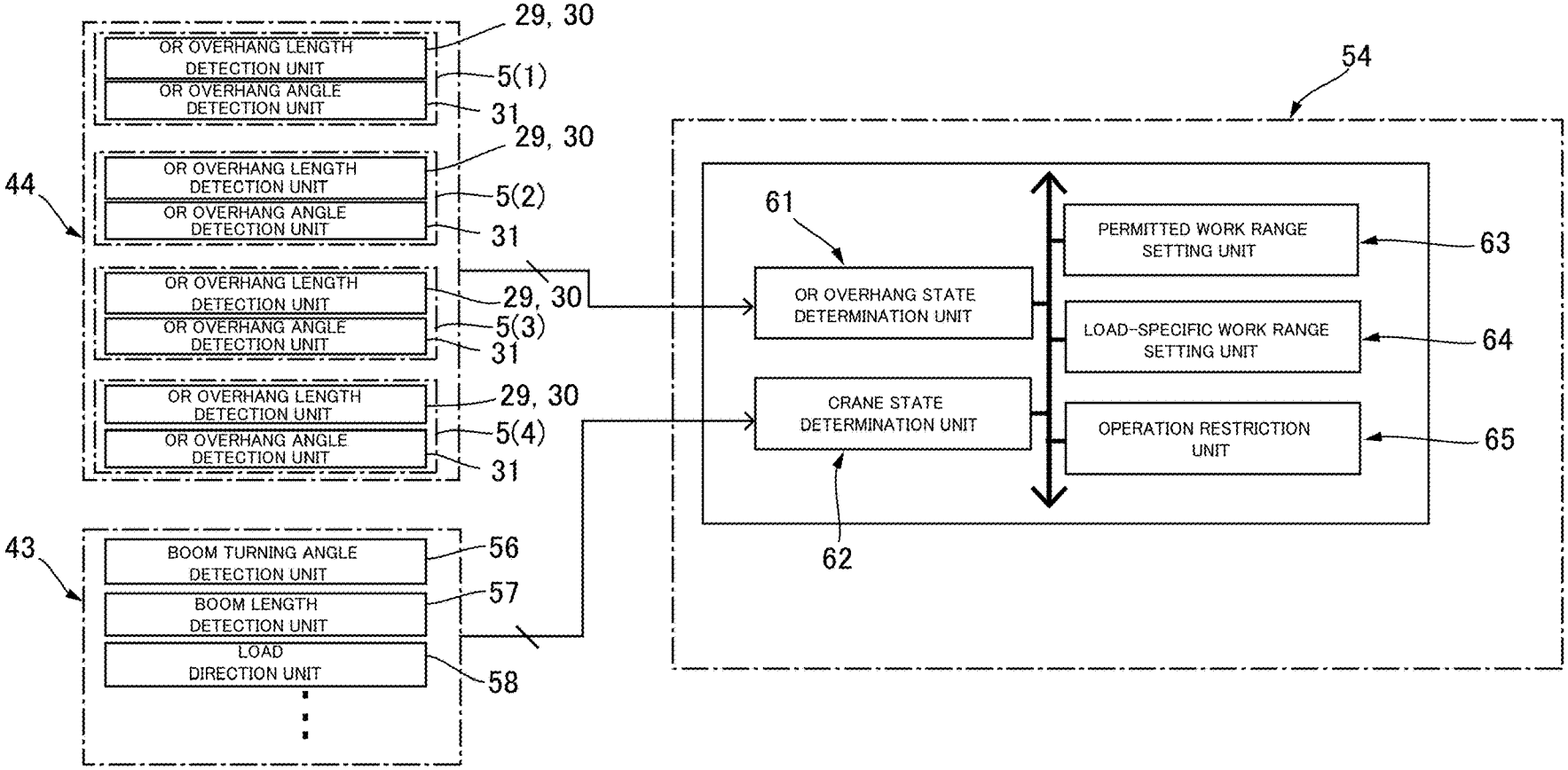
FIG. 6 is a function block diagram showing part of the safety device of the control system of the mobile crane.

FIG. 6 is a function block diagram of the mobile crane 1, centered on the safety device 54 of the lower part controller 40. The safety device 54 sets the working conditions of the crane boom 4 in order to prevent overturning, prevent overloads, etc., on the basis of the overhang states of the four first through fourth outriggers 5(1) to 5(4) of which both the overhang lengths and overhang angles can be varied, and on the basis of these working conditions, the safety device 54 performs operation restriction for the crane work.

Detection signals indicating the respective overhang states of the first through fourth outriggers 5(1) to 5(4) are supplied to the input side of the safety device 54 from the outrigger state detection unit 44, and detection signals, etc., indicating the operation states of the crane boom 4 are supplied from the boom state detection unit 43. The outrigger state detection unit 44 includes proximity sensors 29 and limit switches 30, four each, which are respective outrigger (OR) overhang length detection units for the first through fourth outriggers 5(1) to 5(4), and limit switches 31, which are first through fourth overhang angle detection units that detect the respective overhang angles of the first through fourth outriggers 5(1) to 5(4). The boom state detection unit 43 includes a boom turning angle detection unit 56 that detects the turning angle position of the crane boom 4, a boom length detection unit 57, a load detection unit 58, etc.

The safety device 54 is provided with an OR overhang state determination unit 61, a crane state determination unit 62, a permitted work range setting unit 63 (non-permitted work range setting unit), a load-specific work range setting unit 64, an operation restriction unit 65, and other functional components. On the basis of detection signals from the outrigger state detection unit 44, the OR overhang state determination unit 61 determines the overhang states (whether or not the overhang lengths are at maximum, whether or not the overhang angles are at the reference) of the first through fourth outriggers 5(1) to 5(4). The crane state determination unit 62 discerns the turning angle position of the crane boom 4 on the basis of a detection signal of the boom turning angle detection unit 56. On the basis of the detection results of the boom length detection unit 57, the load detection unit 58, and the other various detection units, the boom length of the crane boom 4, the boom angle, the actual load exerted, etc., are detected.

The permitted work range setting unit 63, in accordance with whether or not each of the overhang angles of the outriggers 5 is the reference overhang angle, sets a permitted-work range in which crane work can be carried out in a crane working area of a maximum work radius centered about the turning center 4A of the crane boom 4. In accordance with whether or not each of the first through fourth outriggers 5(1) to 5(4) is at maximum overhang length, the load-specific work range setting unit 64 sets, within the set range in which work can be carried out, the range at which the crane can work at maximum rated total load as a maximum RTL work range and sets the rest of the range as a minimum RTL work range at which the crane can work at minimum rated total load.

The operation restriction unit 65 allows crane work that does not exceed the maximum rated total load within the set maximum RTL work range, and when a crane operation exceeding this range is instructed, the overload prevention function takes effect, and the operation restriction unit 65 outputs a stop command that forcefully stops the crane operation to the crane boom control unit 53. Upon receiving the stop command, the crane boom control unit 53 forcefully stops the turning operation or another dangerous operation of the crane boom 4. In this case, the crane boom control unit 53 can also abruptly stop the stopping of the turning, etc., of the crane boom 4, but preferably performs regular stop control, which causes gradual turning speed deceleration and stopping. Crane work within the minimum RTL work range can be performed so as to not exceed the minimum rated total load, by switching the rated total load value to the minimum rated total load value.

The detected overhang states of the outriggers 5, the restricted states brought about by the operation restriction unit 65, etc., are displayed by means of the display control unit 55 on the display device 46 of the control panel 7.

For the sake of easier comprehension, the permitted work range setting unit 63, the load-specific work range setting unit 64, etc., are described as individual function blocks. In an actual function block, these are actualized as one control function by software. For example, the correspondences between patterns of outrigger overhang states, such as those shown in FIG. 10 described hereinafter, and the range in which work can be carried out, the maximum RTL work range, and the minimum RTL work range, are stored and kept in internal memory or external memory. The correspondences are referenced and the ranges are preferably calculated from the detected patterns of overhang states of the outriggers 5.

(Range in which Crane Work can be Carried Out and Range in which Work is Prohibited)

Figure 7:
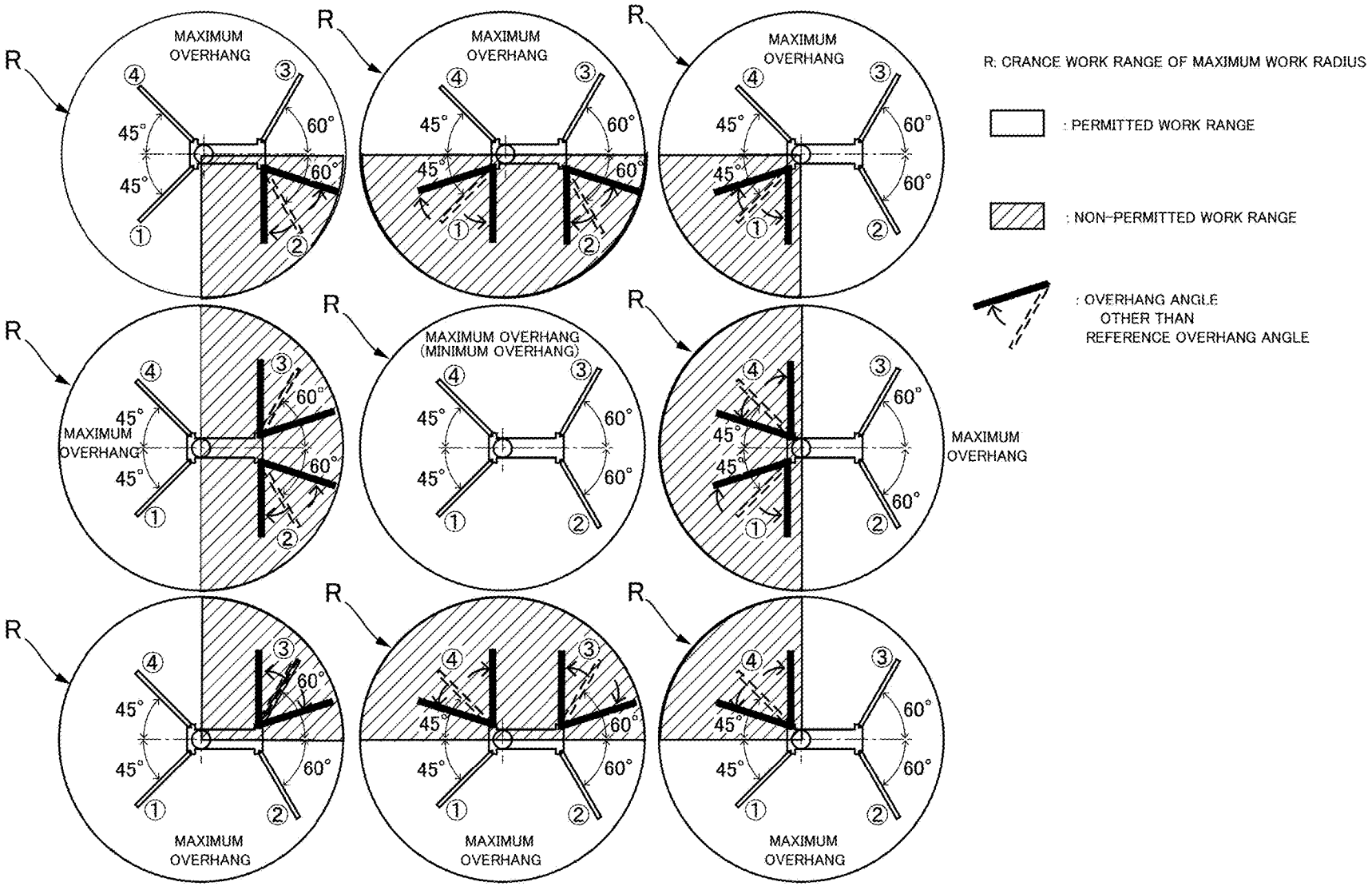
FIG. 7 is an explanatory drawing showing the relationship between outrigger overhang angles and permitted work ranges.

FIG. 7 is an explanatory drawing showing ranges in which work can be carried out and ranges in which work is prohibited, set by the permitted work range setting unit 63. This drawing shows nine patterns of ranges in which work can be carried out and ranges in which work is prohibited, set for each of the four first through fourth outriggers 5(1) to 5(4), in accordance with whether or not the overhang angles are at the reference overhang angles and whether or not the outriggers are at maximum overhang length. The circles centered around the turning center 4A indicate the crane work range R (crane work area) having the maximum work radius. The crane work range R is sectioned every 90 degrees into four first through fourth turning ranges in correlation with the first through fourth outriggers 5(1) to 5(4). In these patterns, the white unfilled portions in the circles indicate ranges in which work can be carried out, and the diagonal-lined portions in the circles indicate ranges in which work is prohibited.

The permitted work range setting unit 63 discerns whether or not a condition is fulfilled, which is that from among the first through fourth outriggers 5(1) to 5(4), the overhang angles of at least two outriggers are at the reference overhang angles, and these two outriggers are the two front-rear or left-right adjacent outriggers of the traveling body 2. When this condition is not fulfilled, the entire crane work range R of the crane boom 4 is set to a range in which work is prohibited.

In other words, when the overhang angles of three or more outriggers are not at the reference overhang angles, and when the overhang angles of the pair of outriggers positioned along the diagonal direction of the traveling body 2 are not at the reference overhang angles, the entire crane work range R is set to a range in which work is prohibited. In this case, the mobile crane 1 cannot be switched to crane mode. The mobile crane 1 must be moved or otherwise operated, the overhang states of the outriggers 5 must be reset, and a stable crane-supporting state must be ensured.

When the above-described condition is fulfilled and the overhang angles of the detected outriggers 5 are at the reference overhang angles, the permitted work range setting unit 63 sets turning angle ranges assigned to those outriggers 5 to a permitted work range in which crane work can be carried out, and otherwise sets those turning angle ranges to a range in which work is prohibited.

(Load-Specific Work Range)

Next, the function of the load-specific work range setting unit 64 is described. In accordance with the overhang states of the outriggers 5, the load-specific work range setting unit 64 sections the range in which work can be carried out into the maximum RTL work range at which crane work is possible with the maximum rated total load, and the minimum RTL work range at which crane work is possible with the minimum rated total load.

Figure 8:
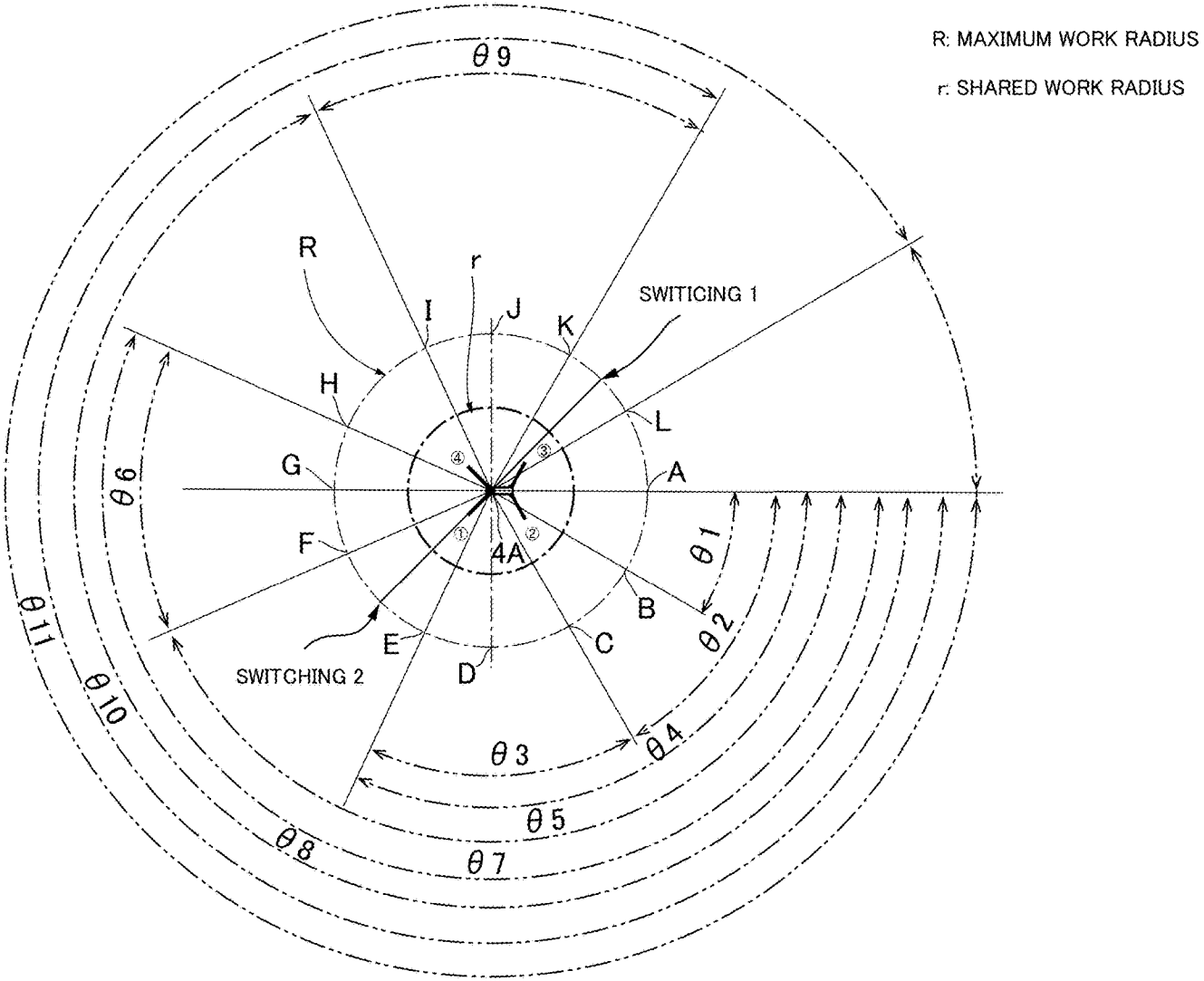
FIG. 8 is an explanatory drawing showing the crane work area and turning angle positions.

FIG. 8 is an explanatory drawing showing examples of turning angle positions that are the borders of the sectioned ranges. The turning angle positions as borders are set in a range that does not result in overturning, on the basis of, for example, line segments joining the turning center 4A and the ground contact points of the outriggers 5 in the maximum overhang states (maximum overhang lengths/overhang states at reference overhang angles). These turning angle positions are also set, for example, on the basis of stability calculations for when the outriggers 5 are in the maximum overhang states, and on the basis of turning angle ranges that are narrowed so as to be safer than turning angle ranges obtained by these calculations. Overhang lengths other than the maximum overhang lengths of the outriggers 5 and overhang states at the reference overhang angles are referred to as minimum overhang states.

In the present example, in the crane work range having the maximum work radius R centered around the turning center 4A of the crane boom 4, a turning angle range is sectioned into eight turning ranges as is shown next. This crane work range includes a crane work range having a work radius (shared work radius) r at which, in a concentric configuration, the rated total load at the maximum overhang state is equal with the rated total load at the minimum overhang state.

(1) Front turning range LAB: the range over angles less than 90 degrees to the left and right, centered about a forward line A extending to the front of the traveling body from the turning center (2) Right turning range CDE: the range over angles less than 90 degrees to the front and rear, centered about a rightward line D extending to the right of the traveling body from the turning center (3) Rear turning range FGH: the range over angles less than 90 degrees to the left and right, centered about a rearward line G extending to the rear of the traveling body from the turning center (4) Left turning range IJK: the range over angles less than 90 degrees to the front and rear, centered about a leftward line J extending to the left of the traveling body from the turning center (5) Forward-right turning range BC: the range between the front turning range and the right turning range (6) Rearward-right turning range EF: the range between the rear turning range and the right turning range (7) Rearward-left turning range HI: the range between the rear turning range and the left turning range (8) Forward-left turning range KL: the range between the left turning range and the front turning range The load-specific work range setting unit 64 sets the right turning range CDE to the maximum RTL work range when the second and first outriggers 5(2), 5(1) at the front and rear on the right side are in the maximum overhang state (the overhang length is the maximum overhang length and the overhang angle is the reference overhang angle). Similarly, the rear turning range FGH is set to the maximum RTL work range when fourth and first outriggers 5(4), 5(1) at the left and right on the rear side are in the maximum overhang state (the overhang length is the maximum overhang length and the overhang angle is the reference overhang angle). The left turning range IJK is set to the maximum RTL work range when the fourth and third outriggers 5(4), 5(3) at the front and rear on the left side are in the maximum overhang state (the overhang length is the maximum overhang length and the overhang angle is the reference overhang angle). The front turning range LAB is set to the maximum RTL work range when the third and second outriggers 5(3), 5(2) at the left and right on the front side are in the maximum overhang state (the overhang length is the maximum overhang length and the overhang angle is the reference overhang angle).

For the crane work range in which the rated total load in the case of a minimum overhang state and the rated total load in the cases of a maximum overhang state are equal (the crane work range having the shared work radius r), there are cases in which safety can be ensured on the basis of a degree of safety calculation, etc. In such cases, the crane work range having the shared work radius r can be set to the maximum RTL work range.

Figure 9:
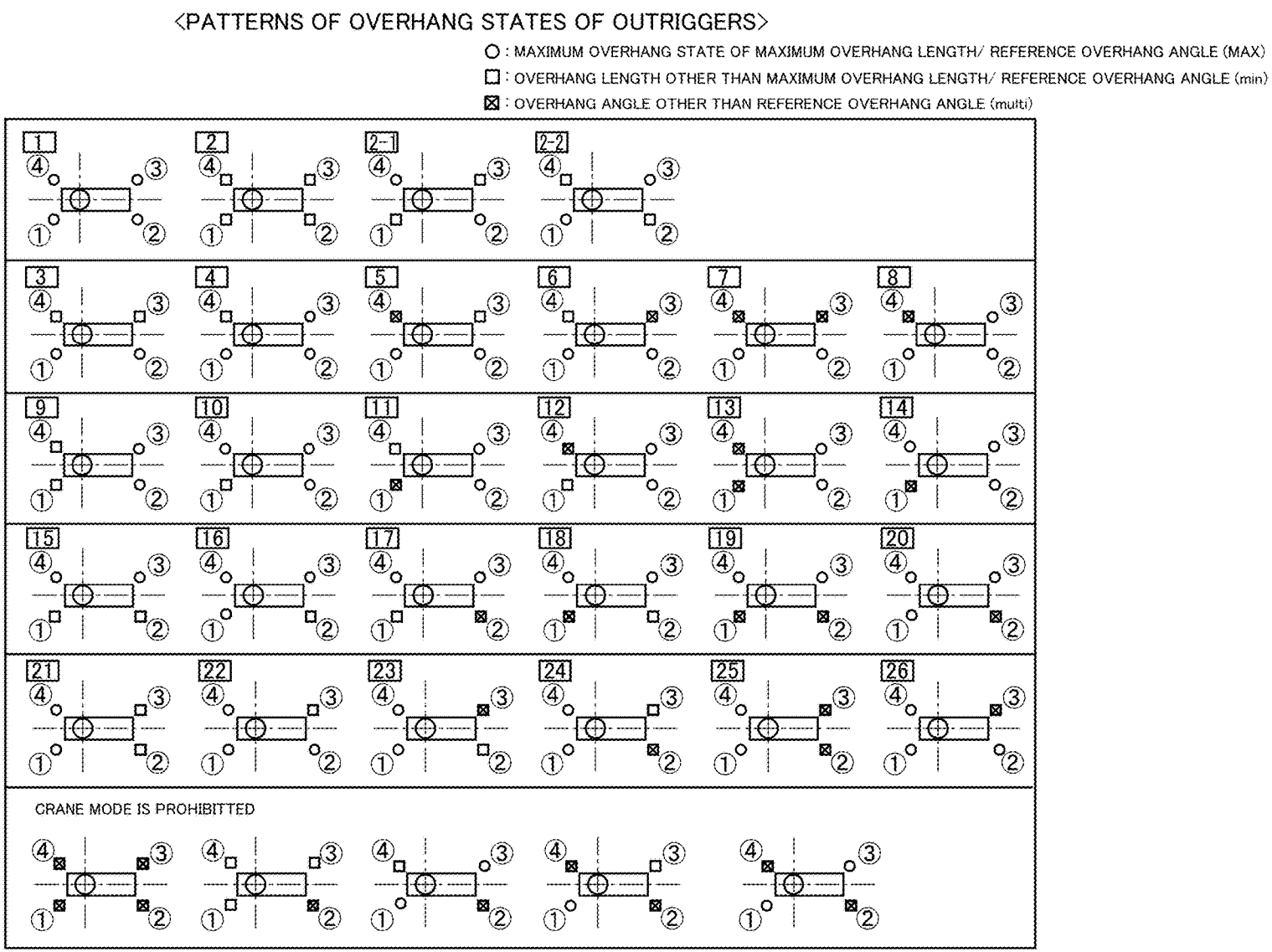
FIG. 9 is an explanatory drawing showing patterns of outrigger overhang states.

FIG. 9 is an explanatory drawing showing patterns of combinations of the overhang states of the outriggers 5(1) to 5(4). FIG. 10 is a table showing the maximum RTL work ranges and the minimum RTL work ranges in these patterns.

The numerals enclosed in square frames in FIG. 9 indicate pattern numbers. In these patterns, when the four outriggers 5(1) to 5(4) are shown as circle symbols, the overhang states are the maximum overhang state (the overhang length is the maximum overhang length and the overhang angle is the reference overhang angle). When the outriggers are shown as square symbols, the overhang lengths are a length other than the maximum overhang length, and the overhang angles are the reference overhang angle. When an x symbol is shown inside the square, the overhang length is irrelevant, and the overhang angle is an angle other than the reference overhang angle.

In the table of FIG. 10, the symbols are as follows.

OR1: the first outrigger

OR2: the second outrigger

OR3: the third outrigger

OR4: the fourth outrigger

Figure 11:
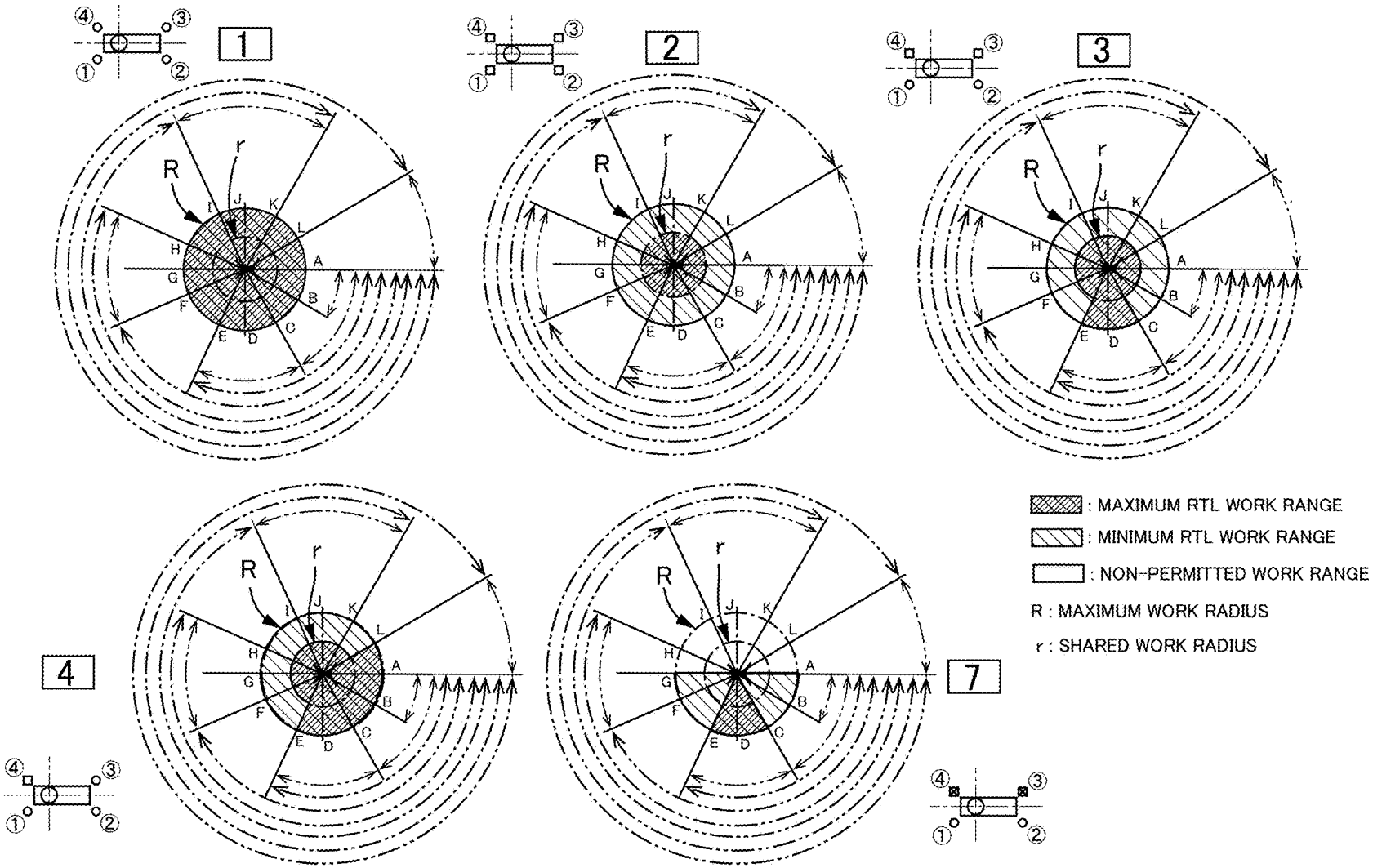
FIG. 11 is an explanatory drawing showing the maximum RTL work ranges and the minimum RTL work ranges of these patterns.
Figure 12:
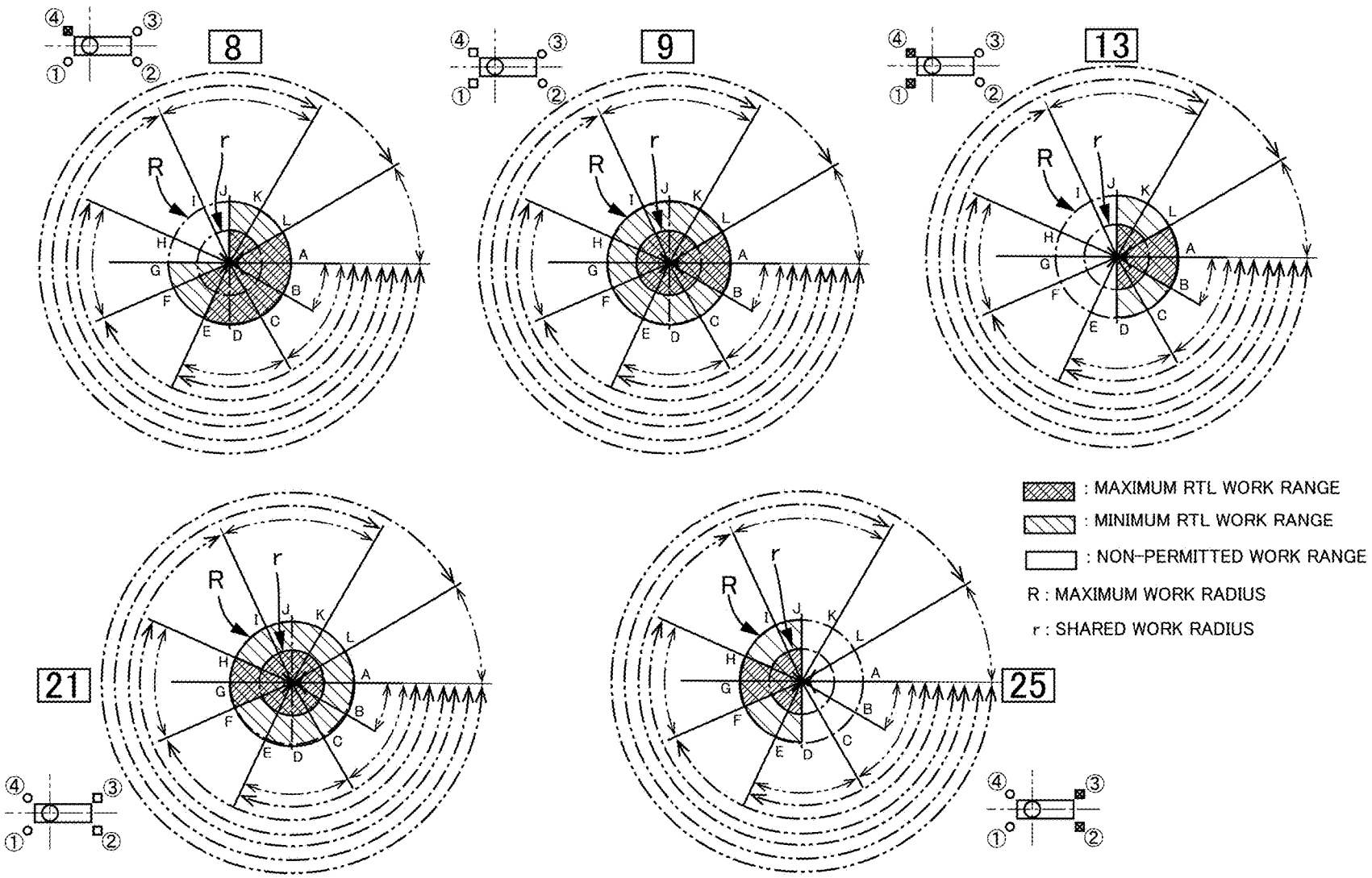
FIG. 12 is an explanatory drawing showing the maximum RTL work ranges and the minimum RTL work ranges of these patterns.

MAX: an outrigger in the maximum overhang state (overhang state is maximum overhang length, and reference overhang angle)

min: an outrigger in an overhang state other than the maximum overhang length, and at the reference overhang angle multi: an outrigger in an overhang state with the overhang length irrelevant, and an overhang angle other than the reference overhang angle LAB: the front turning range over angles less than 90 degrees to the left and right, centered about the forward line A extending to the front of the traveling body from the turning center CDE: the right turning range over angles less than 90 degrees to the front and rear, centered about a rightward line D extending to the right of the traveling body from the turning center FGH: the rear turning range over angles less than 90 degrees to the left and right, centered about the rearward line G extending to the rear of the traveling body from the turning center IJK: the left turning range over angles less than 90 degrees to the front and rear, centered about a leftward line J extending to the left of the traveling body from the turning center BC: the forward-right turning range between the front turning range and the right turning range EF: the rearward-right turning range between the rear turning range and the right turning range HI: the rearward-left turning range between the rear turning range and the left turning range KL: the forward-left turning range between the left turning range and the front turning range Maximum RTL work range: the range in which crane work is possible at the maximum rated total load Minimum RTL work range: the range in which crane work is possible at the minimum rated total load FIG. 11 shows the ranges in which work can be carried out, the maximum RTL work ranges, the minimum RTL work ranges, and the ranges in which work is prohibited in the cases of the patterns 1, 2, 3, 4, and 7 in FIGS. 9 and 10. FIG. 12 shows the ranges in which work can be carried out, the maximum RTL work ranges, the minimum RTL work ranges, and the ranges in which work is prohibited in the cases of the patterns 8, 9, 13, 21, and 25 in FIGS. 9 and 10.

(Display Screen Examples)

Next, the overhang states of the outriggers 5 are displayed on the display screen of the display device 46 of the control panel 7, under the control of the display control unit 55. Additionally, when crane operation has been forcibly stopped by the operation restriction unit 65, a display indicating such an occurrence is shown on the display screen. Additionally, for example, a recovery operation for cancelling the forced stop is displayed on the display screen. When a recovery operation is performed by an operator, a normal standby state is resumed.

FIG. 13 is an explanatory drawing showing display forms of the display screen. FIG. 13(A) is an explanatory drawing showing an example of a screen appearing at startup of the mobile crane 1. In a startup display screen 81, the left and right sides each have five switches 71-75, 76-80 displayed thereon, and manufacturing company logo marks, etc., are displayed on the rectangular display screen 81 between these switches. The startup display screen 81 switches to a home screen 82 shown in FIG. 13(B) when any one or more of the outriggers 5(1) to 5(4) comes out of the stowed state.

The home screen 82 includes a display area 90 in which the planar shape of the mobile crane 1 is displayed, as shown in FIGS. 13(B) and (C). For example, as shown in FIG. 13(C), a crane image is displayed in which the contour shapes of the traveling body 2 of the mobile crane 1, the four outriggers 5(1) to 5(4), and the crane boom 4 are displayed in a prescribed color; e.g., green. When the range in which work can be carried out is set as previously described and the four outriggers 5(1) to 5(4) are properly grounded, lamps 101 to 104 shown in FIG. 13(C) switch from red to, for example, green, and a state arises in which the crane is able to enter crane mode. When the outriggers 5(1) to 5(4) are detected as having been raised, the lamps 101 to 104 displayed for the corresponding outriggers in the crane image switch from green to, for example, red.

Outrigger overhang lamps 91 to 94 are displayed in the respective turning center portions of the outriggers 5. Each of the first through fourth outrigger overhang lamps 91 to 94 can illuminate in a first form, a second form, and a third form. The first form indicates that the designated outrigger 5 is in the maximum overhang state (the overhang state maximum overhang length and reference overhang angle), the second form indicates that the designated outrigger 5 is in an overhang state at the reference overhang angle and an overhang length not the maximum overhang length, and the third form indicates that the designated outrigger 5 is in an overhang state with the overhang angle other than the reference overhang angle. In the present example, the first form (maximum overhang state) is continuous illumination in a first color, e.g., green, the second form is a continuous lighting in a second color, e.g., yellow, and the third form is a continuous lighting in a third color, e.g., red. An operator can thereby roughly recognize the ranges in which crane work can be carried out and the load-specific work ranges.

In addition, the state of crane work is also displayed by these lamps. For example, through the flashing of the yellow light in a yellow-displayed outrigger 5, the operation restriction unit 65 can indicate that turning of the crane boom 4 has been stopped by turning restriction in the direction of that outrigger 5, and through the flashing of the red light in a red-displayed outrigger 5, the operation restriction unit 65 can indicate that the turning of the crane boom 4 has been stopped by turning restriction in the direction of that outrigger 5.

In the present example, a turning direction lamp 95 indicating the direction of the crane boom 4 is displayed centered around the crane boom 4 on the screen, as shown in FIG. 13(C). The turning direction lamp 95 is a lamp in the shape of, for example a quadrant, and when the crane turns, the displayed position switches by 90° at a time. The operator can see the display of the turning direction lamp 95 while causing the crane to turn, and can easily confirm that the function for detecting the crane turning direction has not failed.

(Example of Mechanism for Detecting Boom Turning Angle)

In the mobile crane 1 of the present example, in order for the boom turning angle detection unit 56, which detects the turning angle position of the crane boom 4, to have an inexpensive configuration, the boom turning angle detection unit 56 is configured from, for example, a first potentiometer that detects the rotational angle position of the crane boom 4 in one 180 degree segment, and a second potentiometer that detects the rotational angle position in the other 180 degree segment. The crane state determination unit 62 of the lower part controller 40 is provided with a turning angle calculation function that calculates the turning angle position of the crane boom 4 on the basis of detection signals from the first and second potentiometers.

In this case, the detection signals become inconsistent in a prescribed angle range including an angle range in which the detection signals switch between the first and second potentiometers; therefore, the detecting potentiometer is switched before the control of the crane state determination unit 62 causes this inconsistency, but the angles before and after the switch might be different. In the present example, the range in which crane work at the maximum rated total load is limited is stipulated according to the turning angle position of the crane boom 4. When an error in turning angle detection occurs, crane work cannot be appropriately restricted.

In the present example, the angle position where detection signals switch between the first and second potentiometers is set so as to not coincide with either the turning angle position stipulating the range in which work can be carried out set by the permitted work range setting unit 63, or the turning angle position stipulating the maximum RTL work range set by the load-specific work range setting unit 64. (The first and second potentiometers are arranged so as to yield such a switching angle position). This guarantees that control will be accurately performed using an inexpensively configured turning angle detection mechanism.

A detection mechanism other than a potentiometer can of course be used as the mechanism for detecting the boom turning angle (turning direction). For example, a mechanical switch (limit switch), a proximity switch, or another detection mechanism can be used.

OTHER EMBODIMENTS

In the embodiment described above, the turn-restricting angle at which the maximum RTL range, etc., of the crane boom is restricted is fixed. Instead, variable control can also be performed, in which the turn-restricting angle depending on the length of the crane boom 4 is varied.

For example, the turn-restricting angle width restricting the maximum RTL range is variably controlled on the basis of, for example, the boom length detected by the boom length detection unit 57, which is a limit switch, a length measuring device, or the like. If the crane boom 4 is shorter than the set length, the turn-restricting angle range is widened and the maximum RTL range is widened. In the opposite case, the turn-restricting angle width is narrowed. Doing so makes it possible to achieve better crane performance in a turning range in which safety can be ensured.

The invention claimed is:

1. A safety device for a mobile crane, which restricts crane work in accordance with respective overhang states of four outriggers of which both overhang length and overhang angle can be varied, the outriggers being attached to a traveling body equipped with a crane boom, the safety device comprising:

a permitted work range setting unit that, in accordance with whether or not each of the outrigger overhang angles is a reference overhang angle, sets a permitted work range in which crane work can be carried out within a crane work area having a maximum work radius centered around a turning center of a crane boom; and a load-specific work range setting unit that, in accordance with whether or not each of the outriggers overhang lengths is a maximum overhang length, sets a maximum RTL work range which is a range, within the permitted work range, in which at least crane work at a maximum rated total load can be carried out;

wherein the crane work area is sectioned into four turning angle ranges of 90 degrees each, in correlation with the four outriggers centered about the turning center; and the permitted work range setting unit sets the turning angle ranges assigned to the outriggers, at which the overhang angles are the reference overhang angle, to the permitted work range.

2. A safety device for a mobile crane, which restricts crane work in accordance with respective overhang states of four outriggers of which both overhang length and overhang angle can be varied, the outriggers being attached to a traveling body equipped with a crane boom, the safety device comprising:

a permitted work range setting unit that, in accordance with whether or not each of the outrigger overhang angles is a reference overhang angle, sets a permitted work range in which crane work can be carried out within a crane work area having a maximum work radius centered around a turning center of a crane boom; and a load-specific work range setting unit that, in accordance with whether or not each of the outriggers overhang lengths is a maximum overhang length, sets a maximum RTL work range which is a range, within the permitted work range, in which at least crane work at a maximum rated total load can be carried out;

wherein, when a condition is not fulfilled in that the overhang angles of the four outriggers all be the reference overhang angle, or a condition is not fulfilled in that the overhang angles of at least two outriggers be the reference overhang angle, the overhang lengths be the maximum overhang length, and these two outriggers be located adjacent at the front and rear or the left and right of the traveling body, the permitted work range setting unit sets the entire crane work area to a non-permitted work range in which crane work cannot be carried out, without setting the permitted work range.

3. The safety device for the mobile crane according to claim 2, wherein, where the outrigger on a right rear side of the traveling body is referred to as a first outrigger, the outrigger on a right front side of the traveling body is referred to as a second outrigger, the outrigger on a left rear side of the traveling body is referred to as a fourth outrigger, and the outrigger on the left front side of the traveling body is referred to as a third outrigger, the reference overhang angle of the first and fourth outriggers is a first overhang angle less than 90 degrees, respectively to left and right relative to the traveling body longitudinal direction, and the reference overhang angle of the second and third outriggers is a second overhang angle less than 90 degrees, respectively to the left and right relative to the traveling body longitudinal direction.

4. The safety device for the mobile crane according to claim 3, wherein the crane work area is sectioned into eight turning ranges as follows:

a front turning range over an angle less than 90 degrees to the left and right, centered about a forward line A extending forward along the traveling body from the turning center;

a right turning range over an angle less than 90 degrees forward and backward, centered about a rightward line D extending rightward along the traveling body from the turning center;

a rear turning range over an angle less than 90 degrees to the left and right, centered about a rearward line G extending rearward along the traveling body from the turning center;

a left turning range over an angle less than 90 degrees forward and backward, centered about a leftward line J extending leftward along the traveling body from the turning center;

a forward-right turning range between the front turning range and the right turning range;

a rearward-right turning range between the rear turning range and the right turning range;

a rearward-left turning range between the rear turning range and the left turning range; and a forward-left turning range between the left turning range and the front turning range; and wherein the load-specific work range setting unit:

sets at least the right turning range to the maximum RTL work range when the second and first outriggers at the front and rear on the right side are in the maximum overhang length;

sets at least the rear turning range to the maximum RTL work range when the fourth and first outriggers at the left and right on the rear side are in the maximum overhang length;

sets at least the left turning range to the maximum RTL work range when the fourth and third outriggers at the front and rear on the left side are in the maximum overhang length; and sets at least the front turning range to the maximum RTL work range when the third and second outriggers at the left and right on the front side are in the maximum overhang s length.

5. The safety device for the mobile crane according to claim 4, wherein the load-specific work range setting unit sets the minimum RTL work range, in which the crane work can be carried out at a minimum rated total load, to the maximum RTL work range.

6. The safety device for the mobile crane according to claim 4, wherein the load-specific work range setting unit sets a range other than the maximum RTL work range in the permitted work range, to the minimum RTL work range in which the crane work can be carried out at a minimum rated total load.

7. The safety device for the mobile crane according to claim 6, wherein the first to fourth outriggers are capable of changing overhang lengths thereof to at least the maximum overhang length and a minimum overhang length; and the permitted work range setting unit sets the permitted work range, and the load-specific work range setting unit sets the maximum RTL work range and the minimum RTL work range as defined in the following table A;

TABLE A

| | PATTERNS OF OUTRIGGER OVERHANG STATE | | | | SPECIFICS OF RESTRICTING OPERATIONS | | |
|---|---|---|---|---|---|---|---|
| | OR1 ① | OR2 ② | OR3 ③ | OR4 ④ | PERMITTED-WORK RANGE | MAXIMUM RTL WORK RANGE | MINIMUM RTL WORK RANGE |
| 1 | MAX | MAX | MAX | MAX | ALL | ALL | NONE |
| 2 | min | min | min | min | ALL | NONE | ALL |
| 3 | MAX | MAX | min | min | ALL | CDE | RANGE |
| 4 | MAX | MAX | MAX | min | ALL | LABCDE | OTHER THAN |
| 5 | MAX | MAX | min | multi | ABCDEFG | CDE | MAXIMUM RTL WORK |
| 6 | MAX | MAX | multi | min | ABCDEFG | | RANGE IN |
| 7 | MAX | MAX | multi | multi | ABCDEFG | | PERMITTED-WORK |
| 8 | MAX | MAX | MAX | multi | JKLABCDEFG | LABCDE | RANGE |
| 9 | min | MAX | MAX | min | ALL | LAB | |
| 10 | min | MAX | MAX | MAX | ALL | IJKLAB | |
| 11 | multi | MAX | MAX | min | GHIJKLABCD | LAB | |
| 12 | min | MAX | MAX | multi | JKLABCDEFG | | |
| 13 | multi | MAX | MAX | multi | JKLABCD | | |
| 14 | multi | MAX | MAX | MAX | GHIJKLABCD | IJKLAB | |
| 15 | min | min | MAX | MAX | ALL | IJK | |
| 16 | MAX | min | MAX | MAX | ALL | FGHIJK | |
| 17 | min | multi | MAX | MAX | GHIJKLA | IJK | |

TABLE A-continued

| | PATTERNS OF OUTRIGGER OVERHANG STATE | | | | SPECIFICS OF RESTRICTING OPERATIONS | | |
|---|---|---|---|---|---|---|---|
| | OR1 ① | OR2 ② | OR3 ③ | OR4 ④ | PERMITTED-WORK RANGE | MAXIMUM RTL WORK RANGE | MINIMUM RTL WORK RANGE |
| 18 | multi | min | MAX | MAX | GHIJKLA | | |
| 19 | multi | multi | MAX | MAX | GHIJKLA | | |
| 20 | MAX | multi | MAX | MAX | DEFGHIJKLA | FGHIJK | |
| 21 | MAX | min | min | MAX | ALL | FGH | |
| 22 | MAX | MAX | min | MAX | ALL | CDEFGH | |
| 23 | MAX | min | multi | MAX | ABCDEFGHIJ | FGH | |
| 24 | MAX | multi | min | MAX | DEFGHIJKLA | | |
| 25 | MAX | multi | multi | MAX | DEFGHIJ | | |
| 26 | MAX | MAX | multi | MAX | ABCDEFGHIJ | CDEFGH | |

where

OR1: the first outrigger,

OR2: the second outrigger,

OR3: the third outrigger,

OR4: the fourth outrigger,

MAX: an outrigger in an overhang state in which the overhang length is the maximum overhang length and the overhang angle is the reference overhang angle, min: an outrigger in an overhang state in which the overhang length is other than the maximum overhang length and the overhang angle is the reference overhang angle, multi: an outrigger in an overhang state in which the overhang angle is other than the reference overhang angle with the overhang length irrelevant, LAB: the front turning range over angles less than 90 degrees to the left and right, centered about the forward line A extending to the front of the traveling body from the turning center, CDE: the right turning range over angles less than 90 degrees to the front and rear, centered about a rightward line D extending to the right of the traveling body from the turning center, FGH: the rear turning range over angles less than 90 degrees to the left and right, centered about the rearward line G extending to the rear of the traveling body from the turning center, IJK: the left turning range over angles less than 90 degrees to the front and rear, centered about a leftward line J extending to the left of the traveling body from the turning center, BC: the forward-right turning range between the front turning range and the right turning range, EF: the rearward-right turning range between the rear turning range and the right turning range, HI: the rearward-left turning range between the rear turning range and the left turning range KL: the forward-left turning range between the left turning range and the front turning range, Maximum RTL work range: the range in which crane work is possible at the maximum rated total load, and Minimum RTL work range: the range in which crane work is possible at the minimum rated total load.

8. A safety device for a mobile crane, which restricts crane work in accordance with respective overhang states of four outriggers of which both overhang length and overhang angle can be varied, the outriggers being attached to a traveling body equipped with a crane boom, the safety device comprising:

a permitted work range setting unit that, in accordance with whether or not each of the outrigger overhang angles is a reference overhang angle, sets a permitted work range in which crane work can be carried out within a crane work area having a maximum work radius centered around a turning center of a crane boom;

a load-specific work range setting unit that, in accordance with whether or not each of the outriggers overhang lengths is a maximum overhang length, sets a maximum RTL work range which is a range, within the permitted work range, in which at least crane work at a maximum rated total load can be carried out;

an overhang length detection unit for detecting the overhang lengths of the respective outriggers;

an overhang angle detection unit for detecting the overhang angles of the respective outriggers;

a turning angle detection unit for detecting a turning angle position of the crane boom;

an operation restriction unit for restricting operation of the crane boom based on settings by the permitted work range setting unit and the load-specific work range setting unit; and a display device having a display screen for displaying overhang states of the respective outriggers and operation restriction contents by the operation restriction unit;

wherein the display device has first to fourth outrigger overhang lamps for displaying overhang states of the first to fourth outriggers on the display screen;

wherein each of the first to fourth outrigger overhang lamps is capable of illuminating in a first form, a second form, and a third form; and wherein the first form indicates that the displayed outrigger is in an overhang state in which the overhang length is the maximum overhang length and the overhang angle is the reference overhang angle, the second form indicates that the displayed outrigger is in an overhang state in which the overhang angle is the reference overhang angle and the overhang length is not the maximum overhang length, and the third form indicates that the displayed outrigger is in an overhang state in which the overhang angle is other than the reference overhang angle.

9. The safety device for the mobile crane according to claim 8, wherein the first form is a continuous lighting in a first color, the second form is a continuous lighting in a second color, and the third form is a continuous lighting in a third color;

wherein, in the second form, a flashing of the second color indicates that turning of the crane boom has been stopped by turning restriction in a direction of the outrigger to be designated; and wherein, in the third form, a flashing of the third color indicates that the turning of the crane boom has been stopped by turning restriction in a direction of the outrigger to be designated.

10. A safety device for a mobile crane, which restricts crane work in accordance with respective overhang states of four outriggers of which both overhang length and overhang angle can be varied, the outriggers being attached to a traveling body equipped with a crane boom, the safety device comprising:

a permitted work range setting unit that, in accordance with whether or not each of the outrigger overhang angles is a reference overhang angle, sets a permitted work range in which crane work can be carried out within a crane work area having a maximum work radius centered around a turning center of a crane boom;

a load-specific work range setting unit that, in accordance with whether or not each of the outriggers overhang lengths is a maximum overhang length, sets a maximum RTL work range which is a range, within the permitted work range, in which at least crane work at a maximum rated total load can be carried out;

an overhang length detection unit for detecting the overhang lengths of the respective outriggers;

an overhang angle detection unit for detecting the overhang angles of the respective outriggers; and a turning angle detection unit for detecting a turning angle position of the crane boom;

wherein the turning angle detection unit has a first potentiometer that detects a rotational angle position of the crane boom in one 180 degree segment, and a second potentiometer that detects the rotational angle position in the other 180 degree segment; and wherein an angle position where detection signals switch between the first and second potentiometers is set so as to not coincide with either the turning angle position stipulating the permitted work range set by the permitted work range setting unit, or the turning angle position stipulating the maximum RTL work range set by the load-specific work range setting unit.

* * * * *